United States Patent [19]

Natolino et al.

[11] Patent Number: 4,779,798

[45] Date of Patent: Oct. 25, 1988

[54] GUNNING APPARATUS

[75] Inventors: Romeo Natolino, Burlington, Canada; Paul T. Fennema, Salem, Ohio

[73] Assignee: National Refractories & Minerals Corporation, Oakland, Calif.

[21] Appl. No.: 46,958

[22] Filed: May 7, 1987

[51] Int. Cl.[4] ..... B05B 3/00; B05B 13/06; F27D 1/16

[52] U.S. Cl. ..... 239/227; 239/226; 118/317; 266/281; 264/30

[58] Field of Search ..... 239/226, 227, 263, 263.3; 414/607, 608, 10, 912; 118/317, 323; 266/281, 226; 264/30

[56] References Cited

U.S. PATENT DOCUMENTS

| | | | |
|---|---|---|---|
| 3,351,289 | 11/1967 | Demaison | 239/132.3 |
| 3,737,489 | 6/1973 | Murton | 264/30 |
| 3,799,445 | 3/1974 | Marino | 239/227 |
| 3,957,203 | 5/1976 | Bullard | 118/317 |
| 4,167,246 | 9/1979 | Haus | 239/227 |
| 4,211,367 | 7/1980 | Allison | 239/226 |
| 4,270,949 | 6/1981 | Esposito et al. | 75/60 |
| 4,313,565 | 2/1982 | Focant | 266/281 |
| 4,541,971 | 9/1985 | Takashima | 264/30 |
| 4,690,328 | 9/1987 | Roehl | 239/227 |

*Primary Examiner*—Andres Kashnikow
*Assistant Examiner*—Karen B. Merritt
*Attorney, Agent, or Firm*—Malcolm McQuarrie

[57] ABSTRACT

Gunning apparatus adapted to be carried by a mobile device such as a fork lift truck and inserted in a side door of a furnace such as an electric furnace and used to gun refractory material onto the inside surface of the furnace lining comprises a boom with one end adapted to be attached to the mobile device and the other end carrying a spray nozzle which can be rotated about a vertical axis, the boom also carrying channels to convey, separately, refractory and water to a mixer where the refractory and water are admixed, a channel to carry the admixture to the spray nozzle, and a motor to rotate the spray nozzle.

6 Claims, 3 Drawing Sheets

GUNNING APPARATUS

BACKGROUND OF THE INVENTION

This invention concerns refractory gunning apparatus and particularly such apparatus for gunning the inside of a furnace or ladle or the like.

Many types of apparatus for gunning refractory onto the interior of a furnace or ladle are known in this art.

For example, U.S. Pat. No. 3,351,289 discloses apparatus for applying a protective refractory coating to the lining of a basic oxygen furnace. The apparatus comprises a horizontal boom carrying a spray pipe with angled nozzle at the end. The boom and nozzle are inserted into the top opening of a BOF when such a furnace has been tilted on its side. It will be appreciated by those skilled in the art that this is not the operating position of the BOF, but a special position to which it must be moved for gunning. Also, although the nozzle can be rotated, it can only be rotated about a horizontal axis.

U.S. Pat. No. 3,737,489 discloses a method of applying refractory lining to hot metallurgical ladles, soaking pits, and furnaces using a device which is lowered vertically into the ladle through it open top, the device having a double-ended, horizontally disposed nozzle which rotates about a vertical axis.

Similarly, U.S. Pat. No. 4,167,246 shows apparatus for spraying a refractory lining, the apparatus having a plurality of nozzles shooting in a slightly downward horizontal direction and rotating about a vertical axis; the device is lowered vertically into the ladle.

Again, U.S. Pat. No. 4,270,949 discloses a coating lance which is lowered vertically into a BOF furnace and which has a plurality of downwardly angled nozzles which rotate about the vertical axis of the lance.

Finally, U.S. Pat. No. 4,541,971 shows a method of gunning refractories wherein a nozzle is lowered vertically into a vessel to be gunned through its open top, the nozzle being rotatable about the vertical axis of the supporting pipe and also about a horizontal axis through the lower end of the support pipe and at 90° to the axis of the nozzle.

The apparatus of the present invention differs from those in the prior art in that it is designed to be used with a furnace, for example an electric furnace, in its operating position and to enter such furnace through the work door in its side wall. In other words, with the apparatus of the present invention, it is not necessary to remove the roof of an electric furnace (a substantial undertaking which results in loss of much heat from the furnace) to gun its interior. Also, the use of an overhead crane is not necessary with the apparatus of this invention.

SUMMARY OF THE INVENTION

It has now been found, according to this invention, that an apparatus having the desired characteristics is one which comprises (a) a horizontally extending support boom having a first end adapted to be attached to a movable support mechanism for the apparatus and a second end; (b) said boom also carrying refractory material conveying means and water conveying means to carry refractory material and water separately from adjacent the first end of the boom to the second end; (c) means carried on the second end of the boom and connected to the refractory material carrying means and to the water carrying means for admixing the refractory material and the water; (d) vertical carrying means attached to the second end of the boom and operatively connected to the refractory material carrying means, said vertical carrying means having an upper portion and a lower portion; (e) a rotary joint between the upper and lower portions of the vertical carrying means, whereby said lower portion can be rotated about a vertical axis relative to said upper portion; (f) a horizontally disposed discharge nozzle attached to the lower portion of the vertical carrying means; and (g) motor means carried on the second end of the boom and capable of rotating the lower portion of the vertical carrying means and the discharge nozzle about a vertical axis.

DETAILED DESCRIPTION

Figure 1:
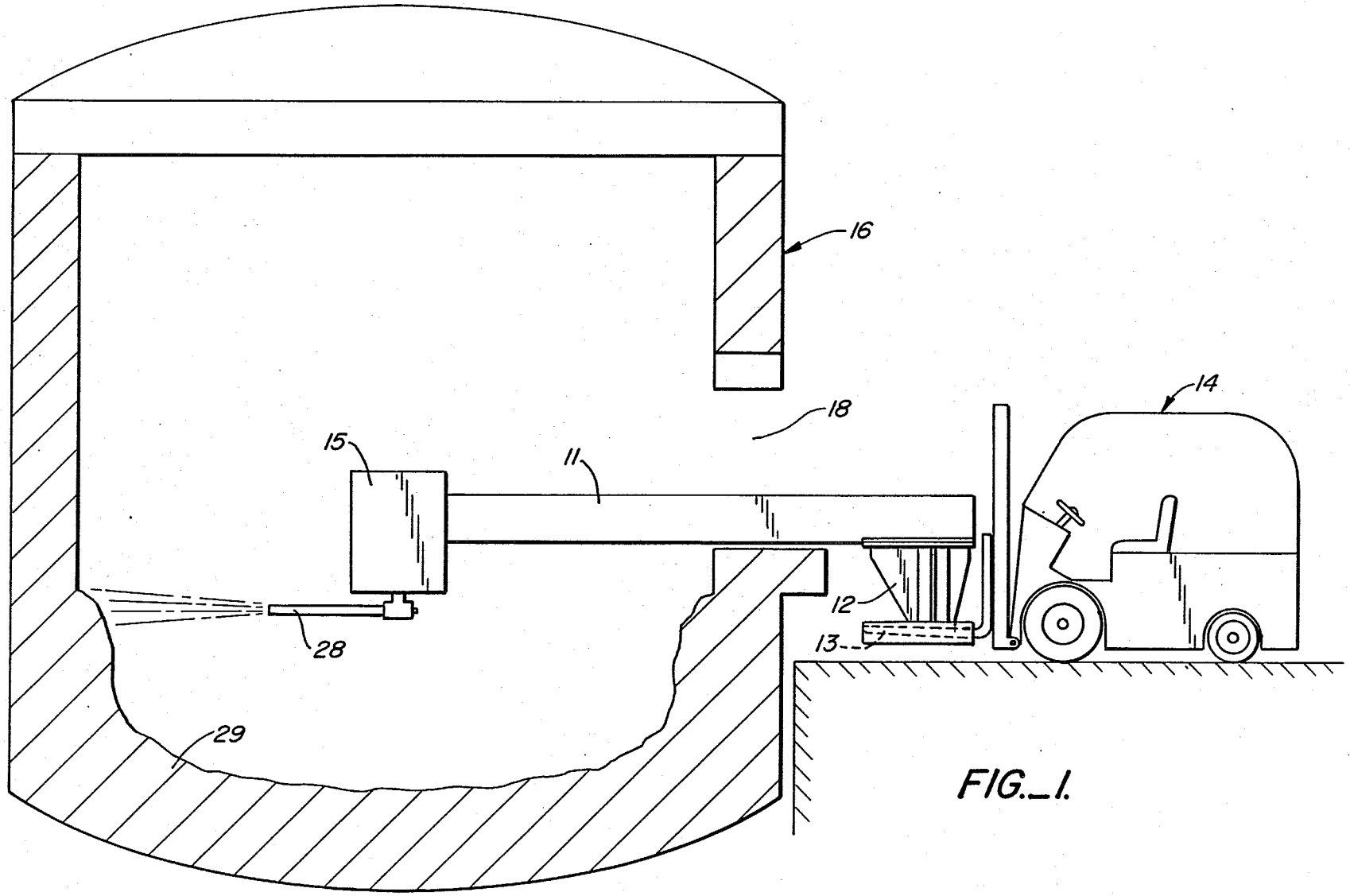
FIG. 1 is an elevation view, partially in section, showing the device of the invention in use in an electric furnace.

The apparatus of this invention comprises a boom, indicated generally by the numeral 11, which has a bracket 12 attached to one end, the bracket 12 having slots 13 adapted to receive the forks of a fork lift truck 14, whereby boom 11 and the equipment it carries can be lifted by fork lift 14 and disposed within a furnace, indicated generally by the numeral 16, through the side or working door 18.

At the other end of boom 11 is an insulated box or container 15, the insulation 34 of box 15 being to protect the equipment within box 15 from the heat of furnace 16.

Boom 11 also carries along its length a pipe or other channel 17 for conveying refractory material from a source (not shown) near the first end of boom 11 to the opposite end. Similarly, boom 11 also carries a pipe or other channel 19 for water and another 20 for air. (The air is used to control an air motor, to be described.) Attached to pipes 19 and 20 are remote control hookups 21 and 23, respectively, for connecting remote controls (not shown) to control the flows of water and air. Alternatively, the flows of water and air can be controlled by valves 26 and 22, respectively.

Figure 4:
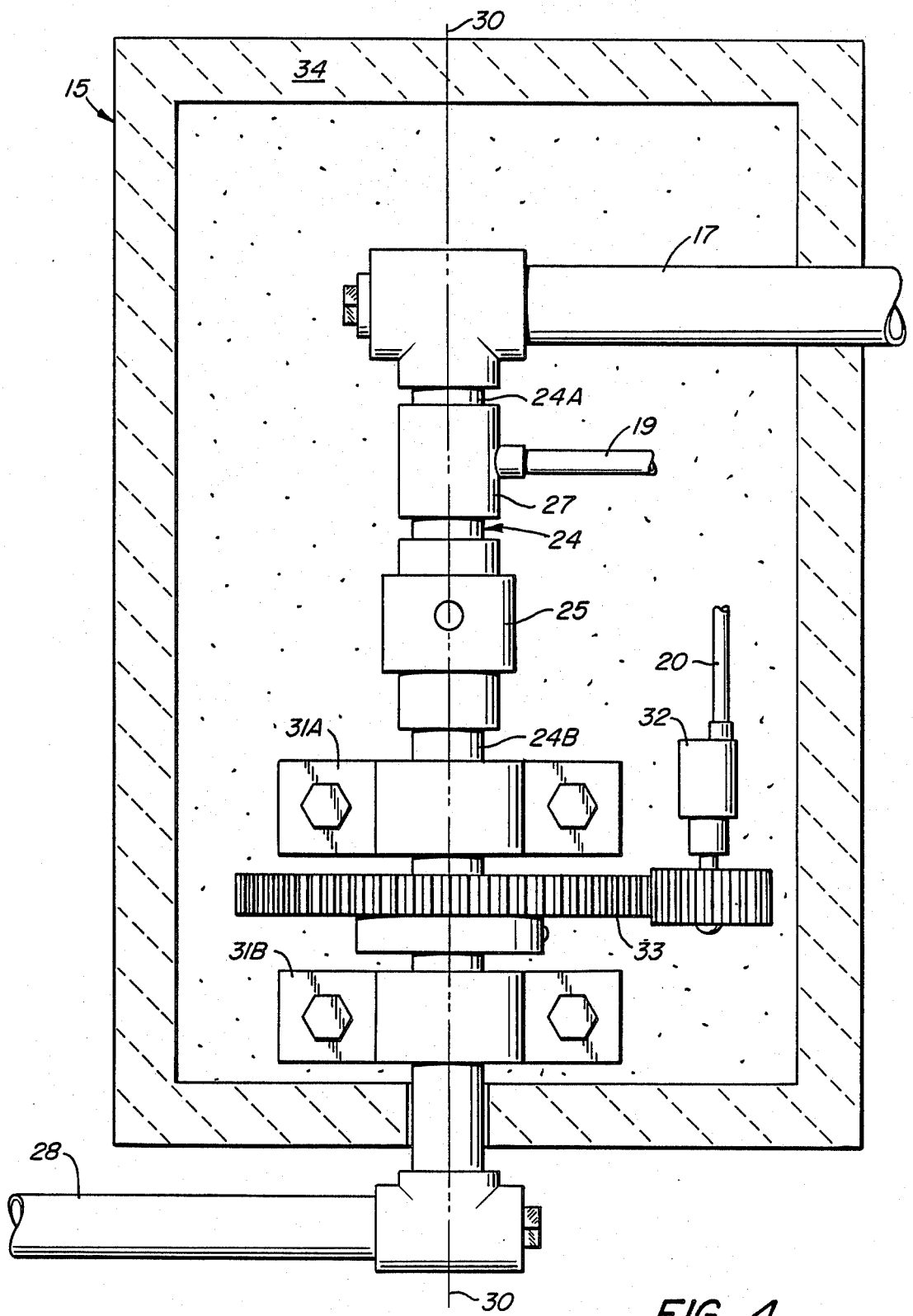
FIG. 4 is a side view, partially in section, showing one end of the device of the invention.

As shown in FIG. 4, refractory material pipe 17 enters box 15 and is joined therein to a vertical conveying pipe which has an upper portion 24A and a lower portion 24B, the two being joined by a rotary joint 25. Rotary joint 25 permits the lower portion 24B of vertical pipe 24 to rotate about a vertical axis 30 through pipe 24 with respect to upper portion 24A, which is fixed with respect to boom 11, box 15, and pipe 17.

Water inlet pipe 19 also enters box 15 and is joined to a water ring 27 (a device well known in this art) which surrounds the upper portion 24A of the vertical pipe. By this means, water can be added through water ring 27 to refractory material passing through pipe 17 and down vertical pipe 24.

The lower end 24B of vertical pipe 24 has attached to it a horizontal nozzle 28, one end of nozzle 28 being connected to vertical pipe 24 and the other being open to permit ejection of refractory material passing through pipes 17 and 24 and nozzle 28, it being understood that all these are connected so as to permit free passage of refractory material from the source (not shown) through pipes 17 and 24 and nozzle 28, out the open end of nozzle 28, and onto the interior of furnace lining 29.

Figure 3:
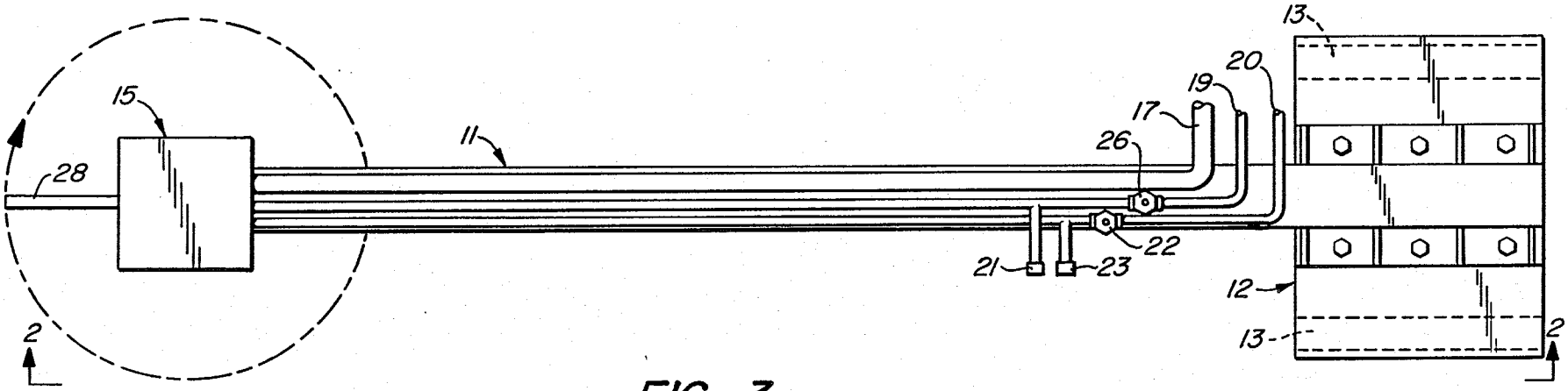
FIG. 3 is a plan view of the device of the invention.
Figure 2:
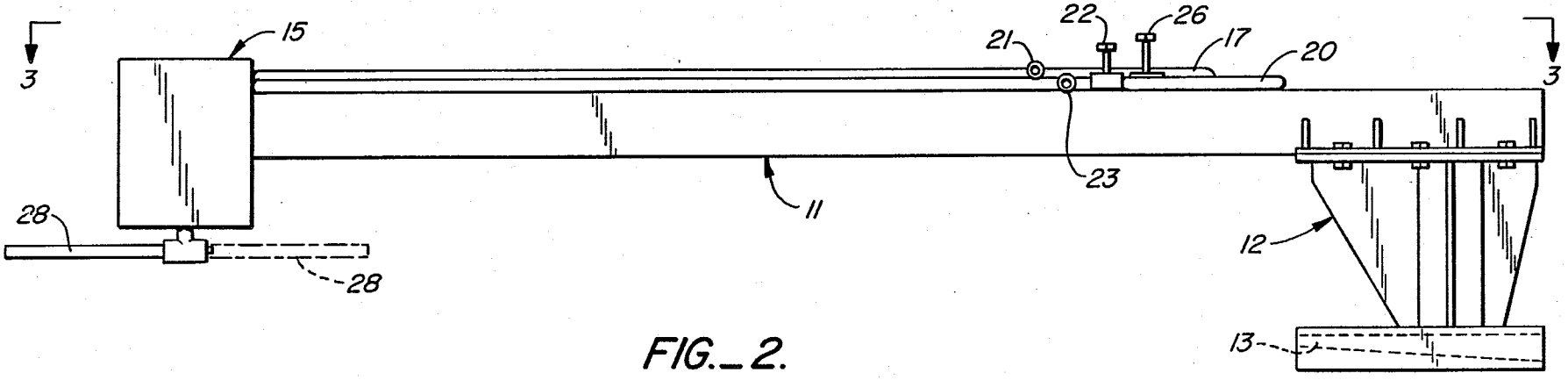
FIG. 2 is a side view of the device of the invention.

The lower end 24B of pipe 24 is supported by two bearings, an upper bearing 31A and a lower bearing 31B, these supporting lower vertical pipe 24B while it rotates. Such rotation is driven by air motor 32, also disposed within insulating box 15, working through an appropriate drive 33. Thus, nozzle 28 is rotated about vertical axis 30, rotation through 360° being possible, as indicated in FIGS. 2 and 3.

While gearing has been shown for drive 33 for driving pipe 24B by air motor 32, it will be understood that other, equivalent means can be used, for example pulleys carried by the air motor and by pipe 24B and connected by a belt or chain drive.

In operation, the apparatus is connected to sources of refractory material, air, and water (not shown), the forks of a fork lift truck are inserted into slots 13, and the apparatus is moved into position with the end of boom 11 carrying box 15 within a furnace 16 to be repaired. Refractory material is then conveyed through pipe 17 by compressed air fed into the source of refractory material (not shown), as is well known in this art, mixed with water conveyed through pipe 19 at water ring 27, and then ejected through nozzle 28 onto furnace lining 29. Air from pipe 20 is used to control air motor 32, which in turn controls rotation of nozzle 28 about the vertical axis of pipe 24, thus distributing refractory material about the circumference of furnace 16.

What is claimed is:

1. Apparatus for gunning refractories onto the interior lining of a furnace, said apparatus comprising:

(a) a horizontally extending support boom having a first end adapted to be attached to a movable support mechanism for the apparatus and a second end;

(b) said boom also carrying refractory material conveying means and water conveying means to carry refractory material and water separately from adjacent the first end of the boom to the second end;

(c) means carried on the second end of the boom and connected to the refractory material carrying means and to the water carrying means for admixing the refractory material and the water;

(d) vertical material carrying means carried on the second end of the boom and operatively connected to the refractory carrying means so as to carry the refractory material downwardly, said vertical carrying means having an upper portion and a lower portion;

(e) a rotary joint between the upper and lower portions of the vertical carrying means, whereby said lower portion can be rotated about a vertical axis relative to said upper portion;

(f) a horizontally disposed discharge nozzle attached to the lower portion of the vertical carrying means; and (g) motor means carried on the second end of the boom and capable of rotating the lower portion of the vertical carrying means and the discharge nozzle about a vertical axis;

whereby said apparatus is adapted to being carried to a furnace to be repaired, being inserted through a side opening in said furnace, and thereafter gunning refractory material onto the interior lining of the furnace.

2. Apparatus according to claim 1 wherein the boom is adapted to be carried by a fork lift truck.

3. Apparatus according to claim 1 wherein the discharge nozzle can be continuously rotated through 360°.

4. Apparatus according to claim 1 wherein the mixing means, the motor means, and the rotary joint are all disposed within an insulating chamber carried on the second end of the boom.

5. Apparatus according to claim 1 wherein the admixing means is a water ring encircling the vertical carrying means above the rotary joint.

6. Apparatus according to claim 1 wherein the motor means is an air motor.

* * * * *